US009394905B2

(12) United States Patent
Kinoshita et al.

(10) Patent No.: US 9,394,905 B2
(45) Date of Patent: Jul. 19, 2016

(54) MOTOR-DRIVEN COMPRESSOR INCLUDING A SHIELD TO BLOCK ELECTROMAGNETIC NOISE

(71) Applicant: KABUSHIKI KAISHA TOYOTA JIDOSHOKKI, Kariya-shi, Aichi-ken (JP)

(72) Inventors: Yusuke Kinoshita, Kariya (JP); Ken Suitou, Kariya (JP); Kazuhiro Kuroki, Kariya (JP); Satoru Egawa, Kariya (JP); Junya Yano, Kariya (JP); Shingo Enami, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 168 days.

(21) Appl. No.: 13/952,267

(22) Filed: Jul. 26, 2013

(65) Prior Publication Data

US 2014/0037470 A1 Feb. 6, 2014

(30) Foreign Application Priority Data

Aug. 3, 2012 (JP) ..... 2012-173024

(51) Int. Cl.

| | |
|---|---|
| ***F04C 18/02*** | (2006.01) |
| ***F01C 21/10*** | (2006.01) |
| ***F04C 23/00*** | (2006.01) |

(52) U.S. Cl.

CPC ..... *F04C 18/0207* (2013.01); *F01C 21/10* (2013.01); *F04C 23/008* (2013.01); *F04C 2240/803* (2013.01); *F04C 2240/808* (2013.01)

(58) Field of Classification Search

CPC .. F04B 53/002; F04C 18/0207; F04C 23/008; F04C 2240/808; F04C 2240/803; F01C 21/10

USPC ..... 417/423.1, 423.14; 310/88

See application file for complete search history.

(56) References Cited

U.S. PATENT DOCUMENTS 8,328,566 B1 * 12/2012 Thibodeaux et al. ..... 439/149
2002/0039532 A1 4/2002 Saito et al.

(Continued)

FOREIGN PATENT DOCUMENTS

EP 2 461 039 A1 6/2012
EP 2 500 516 A2 9/2012

(Continued)

OTHER PUBLICATIONS

Communication dated May 26, 2015 from the State Intellectual Property Office of the People's Republic of China in counterpart application No. 201310325280.9.

(Continued)

*Primary Examiner* — Justin Jonaitis
*Assistant Examiner* — Stephen Mick
(74) *Attorney, Agent, or Firm* — Sughrue Mion, PLLC

(57) ABSTRACT

A motor-driven compressor includes a compression unit, an electric motor, a housing, a cover, wherein the cover includes a main body and a connector coupler, and the cover and the housing define an accommodating chamber, a motor driving circuit that is accommodated in the accommodating chamber and includes a circuit board, and a metal terminal held in the connector coupler, wherein the metal terminal includes first and second end portions. The cover has a shield including a first shield portion, which blocks electromagnetic noise and forms at least part of the connector coupler, and a second shield portion, which blocks electromagnetic noise and forms at least part of the main body. The first and second shield portions are coupled to each other. The second shield portion includes an insertion hole into which one of the first and second end portions of the metal terminal is insertable.

7 Claims, 4 Drawing Sheets

(56) References Cited

U.S. PATENT DOCUMENTS

| | | | | |
|---|---|---|---|---|
| 2009/0068047 | A1* | 3/2009 | Koitabashi et al. | 418/55.2 |
| 2010/0074772 | A1 | 3/2010 | Hoshino et al. | |
| 2010/0143165 | A1* | 6/2010 | Itabashi et al. | 417/366 |
| 2010/0183457 | A1 | 7/2010 | Hattori et al. | |
| 2011/0175470 | A1* | 7/2011 | Kinoshita et al. | 310/71 |
| 2011/0211980 | A1* | 9/2011 | Shibuya et al. | 417/410.1 |
| 2012/0237376 | A1* | 9/2012 | Kinoshita | F01C 21/10 417/423.7 |
| 2013/0034975 | A1* | 2/2013 | Yoshida | H01R 13/2428 439/78 |

FOREIGN PATENT DOCUMENTS

| | | | |
|---|---|---|---|
| JP | 2004019586 | A | 1/2004 |
| JP | 2004-162618 | A | 6/2004 |
| JP | 2009156213 | A | 7/2009 |
| JP | 2009-295340 | A | 12/2009 |
| JP | 2010-093202 | A | 4/2010 |
| JP | 2011-144788 | A | 7/2011 |

OTHER PUBLICATIONS

Communication dated Mar. 15, 2016 from European Patent Office in counterpart Application 13178395.3.

* cited by examiner

MOTOR-DRIVEN COMPRESSOR INCLUDING A SHIELD TO BLOCK ELECTROMAGNETIC NOISE

BACKGROUND OF THE INVENTION

The present invention relates to a motor-driven compressor.

Generally, a motor-driven compressor includes a compression unit, which compresses a refrigerant, and an electric motor, which drives the compression unit. The compression unit and the electric motor are accommodated in a housing having an outer surface to which a cover is coupled. The outer surface of the housing and the cover define an accommodating chamber accommodating a motor driving circuit that drives the electric motor. The motor driving circuit includes a flat circuit board and electric components mounted on the circuit board. Japanese Laid-Open Patent Publication No. 2010-93202 describes an example of such a motor-driven compressor.

SUMMARY OF THE INVENTION

In the motor-driven compressor described above, the cover may include a main body and a connector coupler projecting from the main body. In this case, the connector coupler is connected to a connector leading to an external power supply arranged in the vehicle. The connector coupler accommodates an insulating member holding a metal terminal. The metal terminal has one end electrically connected to the external power supply and another end electrically connected to the circuit board. The cover includes a metal shield that blocks electromagnetic noise from the exterior and from the motor driving circuit. The shield is formed by bending a single metal plate to extend over the main body and the connector coupler. The shield suppresses the transmission of electromagnetic noise from the exterior to the motor driving circuit through the cover and the leakage of electromagnetic noise from the motor driving circuit to the exterior through the cover.

The external power supply connector may be located at any of a variety of positions depending on the type of the vehicle in which the motor-driven compressor is installed. Thus, the position of the connector coupler, which is connected to the external power supply connector, is changed in accordance with the vehicle type. However, since the shield is formed by bending a single metal plate to extend over the main body and the connector coupler, a new shield must be designed whenever the position of the connector coupler is changed to conform to the position of the external power supply connector. Consequently, a new cover needs to be designed for each vehicle type.

It is an object of the present disclosure to provide a motor-driven compressor that allows the position of a connector coupler to be changed to conform to the position of an external power supply connector without the need for designing a new cover, while also allowing a metal terminal to electrically connect an external power supply to a circuit board even when the position of the connector coupler is changed.

To achieve the above object, one aspect of the present invention is a motor-driven compressor including a compression unit configured to compress refrigerant, an electric motor configured to drive the compression unit, a housing that accommodates the compression unit and the electric motor and includes an outer surface, a cover coupled to the outer surface of the housing, wherein the cover includes a main body and a connector coupler connectable to a connector of an external power supply, and the cover and the outer surface of the housing define an accommodating chamber, a motor driving circuit accommodated in the accommodating chamber, wherein the motor driving circuit is configured to drive the electric motor and includes a circuit board, and a metal terminal held in the connector coupler, wherein the metal terminal includes a first end portion, which is electrically connected to the external power supply, and a second end portion, which is electrically connected to the circuit board. The cover includes a shield. The shield includes a first shield portion, which is configured to block electromagnetic noise and which forms at least part of the connector coupler, and a second shield portion, which is configured to block electromagnetic noise and which forms at least part of the main body. The first and second shield portions are coupled to each other. The second shield portion includes an insertion hole into which one of the first and second end portions of the metal terminal is insertable.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

Referring to FIGS. 1A to 2B, one embodiment of a motor-driven compressor will now be described.

Figure 1A:
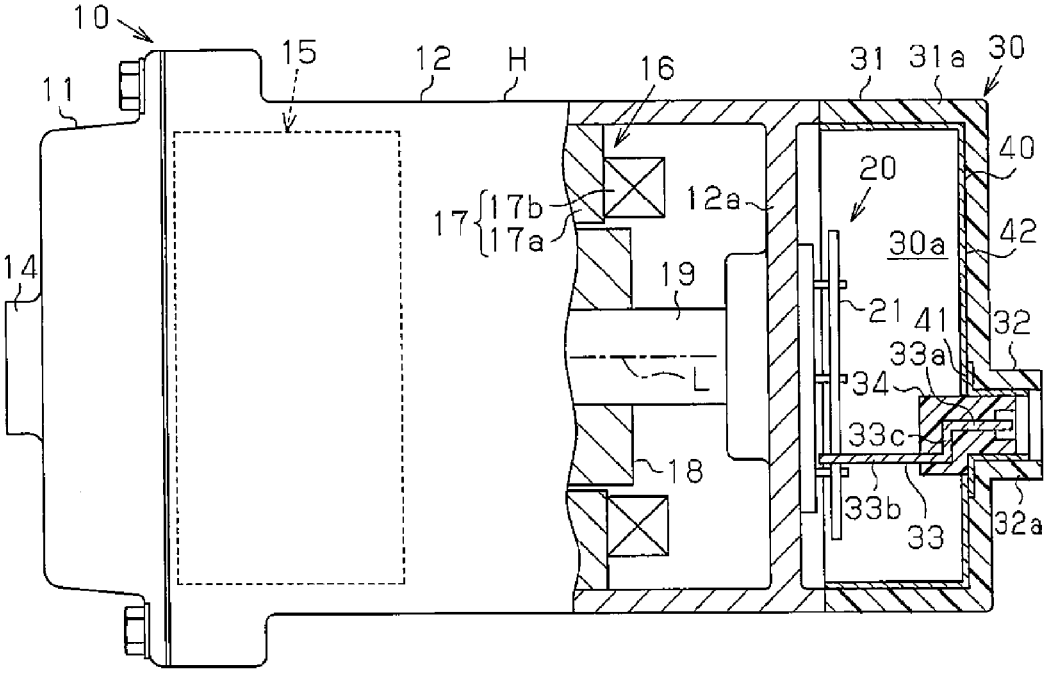
FIG. 1A is a partial cross-sectional view showing one embodiment of a motor-driven compressor.

As shown in FIG. 1A, a motor-driven compressor 10 includes a housing H. The housing H includes an aluminum (metal) discharge housing member 11, which is cylindrical and has a closed end, and an aluminum (metal) suction housing member 12, which is cylindrical, has a closed end, and is coupled to the discharge housing member 11. The suction housing member 12 has a circumferential wall including a suction port (not shown) connected to an external refrigerant circuit (not shown). The discharge housing member 11 includes a discharge port 14 connected to the external refrigerant circuit. The suction housing member 12 accommodates a compression unit 15 (indicated by the broken lines in FIG. 1), which compresses refrigerant, and an electric motor 16, which drives the compression unit 15. Although not shown in the drawings, the compression unit 15 of the present embodiment includes a fixed scroll, which is fixed in the suction housing member 12, and a movable scroll, which is engaged with the fixed scroll.

A stator 17 is fixed to the inner surface of the suction housing member 12. The stator 17 includes a stator core 17*a*, which is fixed to the inner surface of the suction housing member 12, and coils 17*b*, which are wound around teeth (not shown) of the stator core 17*a*. A rotatable rotation shaft 19 extends through the stator 17 in the suction housing member 12. A rotor 18 is fixed to the rotation shaft 19.

Figure 1B:
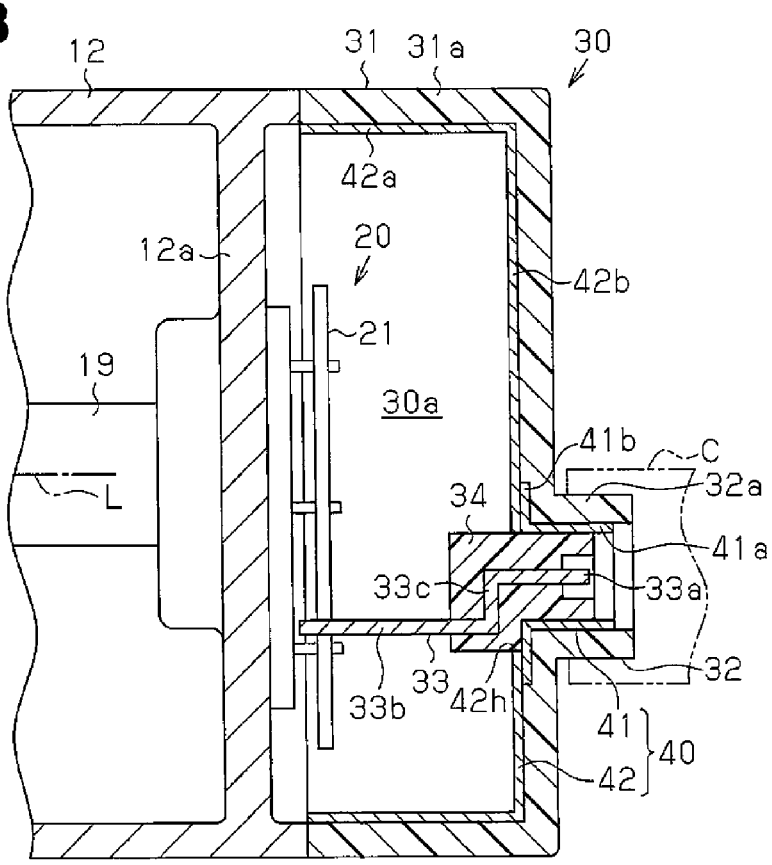
FIG. 1B is an enlarged cross-sectional view showing the motor driving circuit of the motor-driven compressor of FIG. 1A.

As shown in FIG. 1B, the suction housing member 12 has an end wall 12*a* (right side as viewed in FIG. 1B) to which a cover 30 is coupled. The cover 30 is cylindrical and has a closed end. The end wall 12*a* and the cover 30 define an accommodating chamber 30*a*. The accommodating chamber 30*a* accommodates a motor driving circuit 20 that drives the electric motor 16. The motor driving circuit 20 is coupled to the end wall 12*a*. In the present embodiment, the compression unit 15, the electric motor 16, and the motor driving circuit 20 are arranged in this order along the axis L of the rotation shaft 19 (in the axial direction).

The motor driving circuit 20 includes a flat circuit board 21. The circuit board 21 is arranged in the accommodating chamber 30*a* such that a mount surface of the circuit board 21 extends perpendicular to the axial direction of the rotation shaft 19. The circuit board 21 includes a drive control circuit of the electric motor 16 (inverter circuit). The circuit board 21 is electrically connected to electric components such as switching elements (not shown) and capacitors.

The cover 30 includes a main body 31 and a cylindrical connector coupler 32 projecting from the main body 31. The connector coupler 32 is connected to a connector C leading to an external power supply arranged in a vehicle. The cover 30 also includes a shield 40 including a cylindrical first shield portion 41 and a second shield portion 42 that are coupled to each other. The first shield portion 41 blocks electromagnetic noise and forms part of the connector coupler 32. The second shield portion 42 blocks electromagnetic noise and forms part of the main body 31.

The first shield portion 41 includes a first cylinder 41*a*, which extends in the axial direction of the rotation shaft 19, and a flange 41*b*, which extends outward in the radial direction of the rotation shaft 19 from the end of the first cylinder 41*a* opposite to the end connected to the connector C of the external power supply. The second shield portion 42 includes a second cylinder 42*a*, which extends in the axial direction of the rotation shaft 19, and an end portion 42*b*, which extends inward in the radial direction of the rotation shaft 19 from the end of the second cylinder 42*a* that is located closer to the connector coupler 32. The end portion 42*b* includes an insertion hole 42*h*. The flange 41*b* overlaps with and contacts the outer surface of the end portion 42*b*.

The connector coupler 32 includes the first cylinder 41*a* of the first shield portion 41 and a first resin portion 32*a* that is formed integrally with the outer side of the first cylinder 41*a*. The main body 31 includes the second shield portion 42, the flange 41*b* of the first shield portion 41, and a second resin portion 31*a*. The second resin portion 31*a* is formed continuously and integrally with the outer sides of the second cylinder 42*a* and the end portion 42*b* of the second shield portion 42 and the outer side of the flange 41*b*. The second resin portion 31*a* is integral with the second shield portion 42 and the flange 41*b*. The first and second resin portions 32*a* and 31*a* are integrally formed. Thus, the cover 30 includes the first and second resin portions 32*a* and 31*a* that are integral with the shield 40.

In the first cylinder 41*a* (connector coupler 32), a metal terminal 33 is held by a resin insulator 34. The metal terminal 33 includes a first end portion 33*a*, which is electrically connected to the external power supply, and a second end portion 33*b*, which is electrically connected to the circuit board 21. The metal terminal 33 also includes a coupling portion 33*c* between the first and second end portions 33*a* and 33*b*. The metal terminal 33 includes a bend between the first end portion 33*a* and the coupling portion 33*c* and a bend between the coupling portion 33*c* and the second end portion 33*b*. Thus, the coupling portion 33*c* extends in a direction that differs from a direction in which the first and second end portions 33*a* and 33*b* extend. Specifically, the first and second end portions 33*a* and 33*b* extend in the same direction, and the coupling portion 33*c* extends perpendicular to the direction in which the first and second end portions 33*a* and 33*b* extend. The second end portion 33*b* and the coupling portion 33*c* of the metal terminal 33 are located in the cover 30.

The motor driving circuit 20 is driven when power is supplied from the external power supply to the circuit board 21 through the metal terminal 33. The electric motor 16 is supplied with power that is controlled by the motor driving circuit 20. This rotates the rotor 18 and the rotation shaft 19 at a controlled rotation speed and drives the compression unit 15. The driving of the compression unit 15 draws refrigerant from the external refrigerant circuit into the suction housing member 12 through the suction port, compresses the refrigerant in the suction housing member 12 with the compression unit 15, and discharges the compressed refrigerant to the external refrigerant circuit through the discharge port 14.

A method for manufacturing the cover 30 will now be described.

Figure 2B:
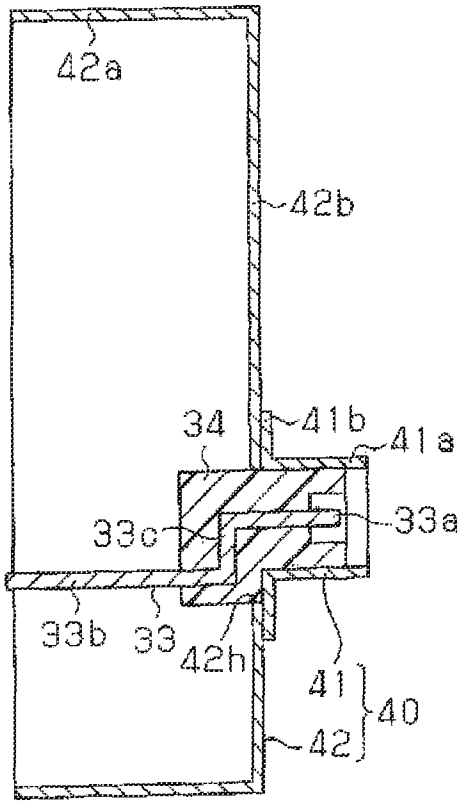
FIG. 2B is a cross-sectional view showing a state where the first and second shield portions are in contact with each other.
Figure 2A:
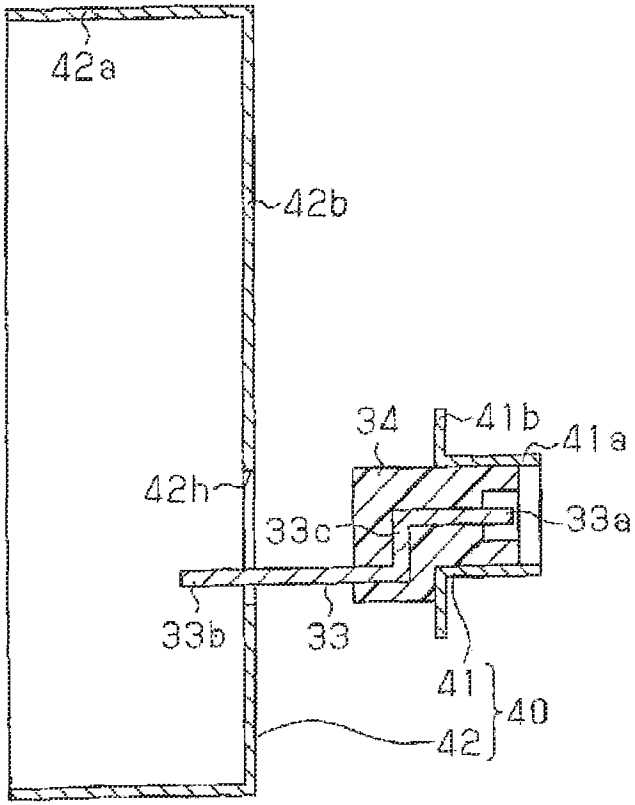
FIG. 2A is a cross-sectional view showing a state before first and second shield portions are brought into contact with each other.

As shown in FIG. 2A, when the metal terminal 33 is held by the insulator 34 in the first cylinder 41*a* of the first shield portion 41, the first shield portion 41 is positioned relative to the second shield portion 42 to insert the second end portion 33*b* of the metal terminal 33 into the insertion hole 42*h* from the outer side of the second shield portion 42. Then, as shown in FIG. 2B, the flange 41*b* of the first shield portion 41 is brought into contact with the outer surface of the end portion 42*b* of the second shield portion 42. Here, the second end portion 33*b* and the coupling portion 33*c* of the metal terminal 33, and part of the insulator 34 are inserted through the insertion hole 42*h* and located in the second shield portion 42.

The first and second shield portions 41 and 42 are then coupled through swaging, welding, or the like and placed in a mold (not shown). The mold is filled with molten resin, and the resin is hardened. This molds the first and second resin portions 32*a* and 31*a* on the outer sides of the first and second shield portions 41 and 42. The cover 30 is formed in this manner.

The operation of the present embodiment will now be described.

The position of the connector C of the external power supply varies depending on the type of vehicle in which the motor-driven compressor 10 is installed. In the present embodiment, the first shield portion 41 is coupled to the second shield portion 42 with the position of the first shield portion 41 in conformance with the position of the connector C of the external power supply. This eliminates the need for designing a new shield 40 to change the position of the connector coupler 32 in conformance with the position of the connector C of the external power supply. As a result, the position of the connector coupler 32 can be easily changed to conform to the position of the connector C of the external power supply without the need for designing a new cover 30. Further, the insertion hole 42*h* formed in the second shield portion 42 allows the second end portion 33*b* of the metal terminal 33 to be inserted into the second shield portion 42 through the insertion hole 42*h*. This allows the metal terminal 33 to connect the external power supply to the circuit board 21 even when the position of the connector coupler 32 is changed.

The first and second shield portions 41 and 42 block electromagnetic noise from the exterior and the motor driving circuit 20. This suppresses the transmission of the noise from the exterior to the motor driving circuit 20 through the cover 30 and the leakage of noise from the motor driving circuit 20 to the exterior through the cover 30.

The advantages of the present embodiment will now be described.

(1) The shield 40 includes the first and second shield portions 41 and 42 that are coupled to each other. In addition, the second shield portion 42 includes the insertion hole 42*h* into which the second end portion 33*b* of the metal terminal 33 is insertable. This allows the first and second shield portions 41 and 42 to be discrete from each other. Thus, the first shield portion 41 can be coupled to the second shield portion 42 with the position of the first shield portion 41 in conformance with the position of the connector C of the external power supply. This eliminates the need for designing a new shield 40 to arrange the connector coupler 32 in correspondence with the connector C of the external power supply. As a result, the position of the connector coupler 32 can be easily changed to conform to the connector C of the external power supply without the need for designing a new cover 30. Further, the second shield portion 42 includes the insertion hole 42*h*. The insertion of the second end portion 33*b* of the metal terminal 33 into the insertion hole 42*h* allows the metal terminal 33 to electrically connect the external power supply to the circuit board 21 even when the position of the connector coupler 32 is changed.

(2) The metal terminal 33 includes the coupling portion 33*c* that couples the first end portion 33*a* to the second end portion 33*b*. The coupling portion 33*c* extends in a direction that differs from the direction in which the first and second end portions 33*a* and 33*b* extend. The motor-driven compressor 10 that includes the metal terminal 33 having the coupling portion 33*c* is especially advantageous. For example, when the second end portion 33*b* of the metal terminal 33 is required to be connected to a predetermined portion of the circuit board 21, the second end portion 33*b* of the metal terminal 33 can be connected to the predetermined portion by bending the metal terminal 33. This eliminates the need for adjusting the position of the circuit board 21.

(3) The coupling portion 33*c* of the metal terminal 33 is insertable into the insertion hole 42*h*. Thus, the axial length of the connector coupler 32 can be reduced compared to when the coupling portion 33*c* is not insertable into the insertion hole 42*h* and located outside the second shield portion 42. This allows for reduction in the size of the motor-driven compressor 10.

(4) The first shield portion 41 is coupled to the outer side of the second shield portion 42. If the first shield portion 41 is coupled to the inner side of the second shield portion 42, for example, the first cylinder 41*a* of the first shield portion 41 is required to be inserted into the insertion hole 42*h* from the inside and extend out of the second shield portion 42. If the first cylinder 41*a* has a complex shape, the insertion of the first cylinder 41*a* through the insertion hole 42*h* may be difficult. Even when the first cylinder 41*a* has a complex shape, the first shield portion 41 can be easily coupled to the second shield portion 42 by coupling to the outer side of the second shield portion 42

(5) The flange 41*b* of the first shield portion 41 is in contact with the end portion 42*b* of the second shield portion 42. Thus, the electromagnetic noise blocked by the first shield portion 41 is easily transmitted to the second shield portion 42. This facilitates the blockage of electromagnetic noise.

(6) The cover 30 includes the first and second resin portions 32*a* and 31*a* that are integral with the shield 40. This reduces the weight of the cover 30 compared to when the entire cover 30 is made of metal.

It should be apparent to those skilled in the art that the present invention may be embodied in many other specific forms without departing from the spirit or scope of the invention. Particularly, it should be understood that the present invention may be embodied in the following forms.

Figure 3:
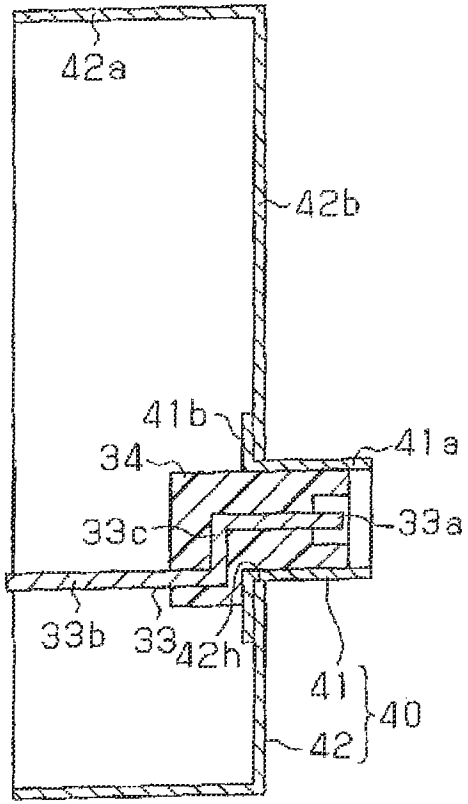
FIG. 3 is a cross-sectional view showing first and second shield portions in another embodiment.

As shown in FIG. 3, the first shield portion 41 may be coupled to the inner side of the second shield portion 42. In this structure, the insertion hole 42*h* is required to have a size capable of receiving the first end portion 33*a* of the metal terminal 33 and the first cylinder 41*a* of the first shield portion 41.

Figure 4:
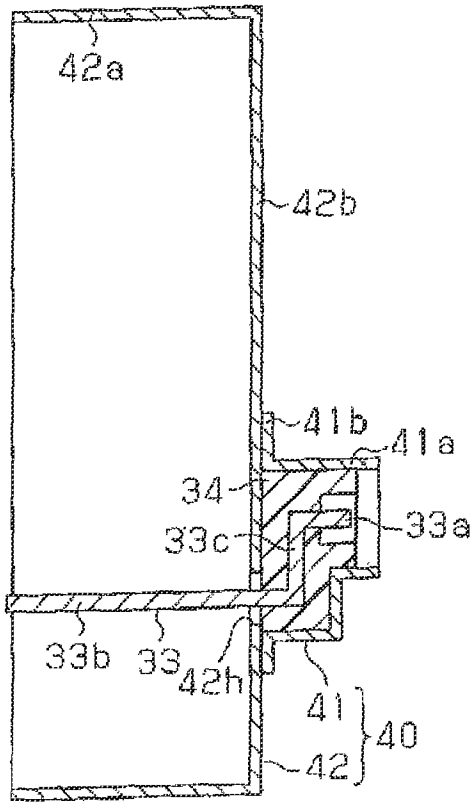
FIG. 4 is a cross-sectional view showing first and second shield portions in a further embodiment.

As shown in FIG. 4, the coupling portion 33*c* is not required to be inserted through the insertion hole 42*h* and may be located outside the second shield portion 42. In this structure, the insertion hole 42*h* is required to receive only the second end portion 33*b* of the metal terminal 33. This minimizes the size of the insertion hole 42*h*.

Figure 5:
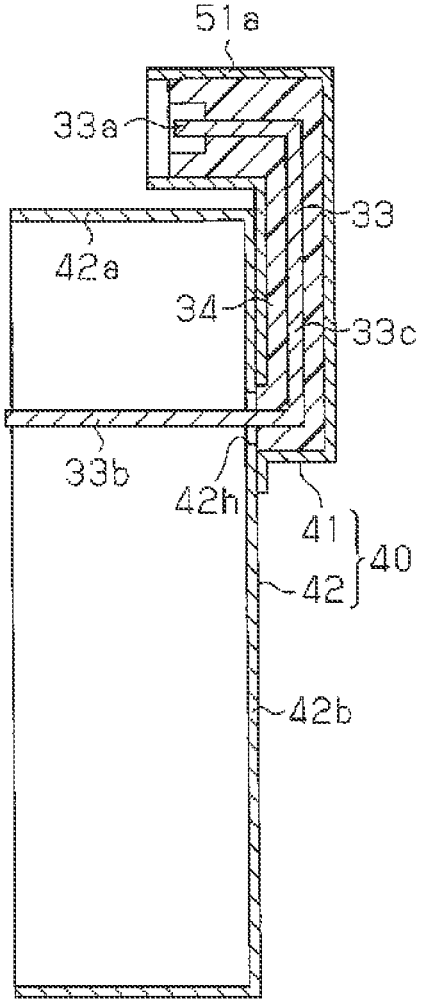
FIG. 5 is a cross-sectional view showing first and second shield portions in yet another embodiment.

As shown in FIG. 5, the first shield portion 41 may include a first cylinder 51*a* that extends along the end portion 42*b* of the second shield portion 42 and then extends toward the electric motor 16 in the axial direction of the rotation shaft 19.

The first shield portion 41 does not have to be in contact with the second shield portion 42. For example, a resin member may be arranged between the flange 41*b* of the first shield portion 41 and the end portion 42*b* of the second shield portion 42.

The entire cover 30 may be formed from metal. In this structure, the connector coupler is formed only by the first shield portion, and the main body is formed only by the second shield portion.

The metal terminal 33 may be straight, for example. Further, the coupling portion 33*c* and one of the first and second end portions 33*a* and 33*b* may extend along the same straight line.

The metal terminal 33 may be curved from the first end portion 33*a* to the coupling portion 33*c* and from the coupling portion 33*c* to the second end portion 33*b*.

A resin member may be arranged integrally with the inner side of the shield 40. Further, a resin member may be arranged integrally with the inner and outer sides of the shield 40.

The cover 30 may be coupled to the outer radial surface of the suction housing member 12. An accommodating chamber defined by the outer radial surface of the suction housing member 12 and the cover 30 may accommodate the motor driving circuit 20.

The compression unit 15 may be of a piston type or a vane type.

Therefore, the present examples and embodiments are to be considered as illustrative and not restrictive and the invention is not to be limited to the details given herein, but may be modified within the scope and equivalence of the appended claims.

The invention claimed is:

1. A motor-driven compressor comprising:

a compression unit configured to compress refrigerant;

an electric motor configured to drive the compression unit;

a rotation shaft configured to transmit a driving force of the electric motor to the compression unit;

a housing that accommodates the compression unit, the electric motor and the rotation shaft and includes an outer surface;

a cover formed of resin and coupled to the outer surface of the housing, wherein the cover includes a main body and a connector coupler connectable to a connector of an external power supply, and the cover and the outer surface of the housing define an accommodating chamber;

a motor driving circuit accommodated in the accommodating chamber, wherein the motor driving circuit is configured to drive the electric motor and includes a circuit board;

a metal terminal held in the connector coupler, wherein the metal terminal includes a first end portion, which is electrically connected to the external power supply, and a second end portion, which is electrically connected to the circuit board; and a shield including a first shield portion and a second shield portion, which are formed of metal and integrally formed with the cover formed of resin, wherein the first shield portion is configured to block electromagnetic noise and forms at least part of the connector coupler, and the second shield portion is configured to block electromagnetic noise and forms at least part of the main body, the first and second shield portions are coupled to each other, the second shield portion includes an insertion hole into which one of the first and second end portions of the metal terminal is insertable, the first shield portion includes a first cylinder shaped portion, which extends in a direction of the rotation shaft and is configured to accommodate the first end portion of the metal terminal, and a flange portion, which extends from the first cylinder shaped portion in a radial direction with respect to the rotation shaft, the second shield portion includes a second cylinder shaped portion, which extends in a direction parallel to the axial direction of the rotation shaft, and a planer end portion, which is formed at one end of the second cylinder shaped portion and extends radially inward, with respect to the rotation shaft, from the one end of the second cylinder shaped portion, the insertion hole is formed in the planer end portion, and the flange portion of the first shield portion overlaps with one of an inner surface or an outer surface of the planer end portion of the second shield portion, and the flange portion is in contact with and coupled to the one of the inner surface or the outer s face of the planer end portion.

2. The motor-driven compressor according to claim 1, wherein the metal terminal includes a coupling portion coupling the first end portion to the second end portion, and the coupling portion extends in a direction that differs from a direction in which at least one of the first and second end portions extends.

3. The motor-driven compressor according to claim 2, wherein the insertion hole is configured to allow for insertion of the coupling portion into the insertion hole.

4. The motor-driven compressor according to claim 2, wherein the coupling portion is located in the second shield portion.

5. The motor-driven compressor according to claim 1, wherein the flange portion of the first shield portion is coupled to the outer surface of the planer end portion of the second shield portion.

6. The motor-driven compressor according to claim 1, wherein the compression unit, the electric motor, and the motor driving circuit are arranged in this order along the axial direction of the rotation shaft.

7. The motor-driven compressor according to claim 1, wherein the shield is disposed on an inner surface of the cover.

* * * * *